US008647165B1

(12) United States Patent
Blackwood et al.

(10) Patent No.: US 8,647,165 B1
(45) Date of Patent: Feb. 11, 2014

(54) PLAY PANEL INSTALLATION

(75) Inventors: Kim Blackwood, Boaz, AL (US); Pedro Jose Pascuales, Gadsden, AL (US)

(73) Assignee: Playcore Wisconsin, Inc., Chattanooga, TN (US)

( * ) Notice: Subject to any disclaimer, the term of this patent is extended or adjusted under 35 U.S.C. 154(b) by 132 days.

(21) Appl. No.: 13/356,744

(22) Filed: Jan. 24, 2012

(51) Int. Cl.
*A63H 33/04* (2006.01)
*A63H 33/10* (2006.01)

(52) U.S. Cl.
USPC ..... 446/105; 446/227; 472/136

(58) Field of Classification Search
USPC ..... 472/136, 137; 446/105, 107, 227, 476, 446/479, 482; 434/258
See application file for complete search history.

(56) References Cited

U.S. PATENT DOCUMENTS

| | | | | |
|---|---|---|---|---|
| 5,319,905 | A * | 6/1994 | Szirtes | 52/108 |
| 5,454,745 | A * | 10/1995 | Spielberger | 446/71 |
| 5,938,566 | A * | 8/1999 | Rodriguez-Ferre | 482/35 |
| 6,066,022 | A * | 5/2000 | Fobean et al. | 446/227 |
| 6,206,384 | B1 * | 3/2001 | Chi et al. | 280/30 |

* cited by examiner

*Primary Examiner* — Kien Nguyen
(74) *Attorney, Agent, or Firm* — McAndrews, Held & Malloy, Ltd.

(57) ABSTRACT

A panel installation provides a panel spaced between first and second uprights. The panel has first and second wings having wing wall portions preferably contacting the uprights above spaced side wall portions spaced from the uprights. Cutouts in the wings allow for insertion of a connector through the wings into threaded bores in the uprights. A deck between the uprights can receive connector(s) for connecting a lower portion of the panel to the deck.

20 Claims, 1 Drawing Sheet

PLAY PANEL INSTALLATION

FIELD OF THE INVENTION

The present invention relates to a panel installation for use with a play device such as playground equipment.

BACKGROUND OF THE INVENTION

Play panels of various constructions have been used with playgrounds. However, connecting these prior art panels to other playground equipment has proved to be frustrating. The panels would normally have side walls that extend vertically along their entire height. Connector fittings such as horizontally extending cylinders which may, or may not, be a part of a frame span between a vertical post and the side wall of the panel. These cylinders connect to the vertical post at a connection which is normally a saddle adjacently connected to the post and a cap. The cylinder is then aligned with the saddle and the cap connects securely over the interface of the cylinder end and saddle adjacently to the end of the saddle. This connection is secure, but expensive and normally leaves the cap end exposed.

Accordingly, a need exists to provide an improved panel and installation.

SUMMARY OF THE INVENTION

It is a present object of the present invention to provide an improved panel and/or panel installation.

It is an object for at least some embodiments to provide a more cost effective connection for a panel to a vertical post.

It is another object of many embodiments of the present invention to provide a panel which can be securely connected to other playground structure in a secure manner which minimizes harsh edges or surfaces, such as sharp edges which might be accessed by children.

Accordingly, panels of a presently preferred embodiment provide integral wings extending beyond vertical side wall. The wings connect adjacently at least at an upper portion of the panel to vertically extending posts. The wings have a cutout internally disposed relative to an external wing wall portion. The cutout preferably has an upper surface, lower surface and an internal portion which corresponds with the external wall portion to provide the cutout.

A connector, such as a bolt, possibly extending through a washer and/or a lock washer extends into the wing wall, such as in a recess or well in the wing wall, through the internal wing wall and out an external wing wall surface which preferably contacts the vertical post. The connector continues on into the interior of the post where it is preferably threadedly received. Thus there is a single connector, installed in a threaded connection within the cutout, through the wing wall, and into the vertical post to secure the upper portion of the panel to the post. In the preferred embodiments, wing walls are disposed at upper portions, such as symmetrically. This can provide a "T" (tee) or "+" (plus) appearance.

Wings could be provided similarly at lower portions to vertical posts although in the presently preferred embodiment, the bottom of the panel is installed to a deck portion such as a deck portion spanning two uprights, like two uprights to which opposing wing walls connect at an upper portion of the panel.

This style installation provides a securely connected panel having extremely few exposed connector portions which might otherwise scratch a child during play.

BRIEF DESCRIPTION OF THE DRAWINGS

The particular features and advantages of the invention as well as other objects will become apparent from the following description taken in connection with the accompanying drawings in which.

DETAILED DESCRIPTION OF THE DRAWINGS

Figure 1:
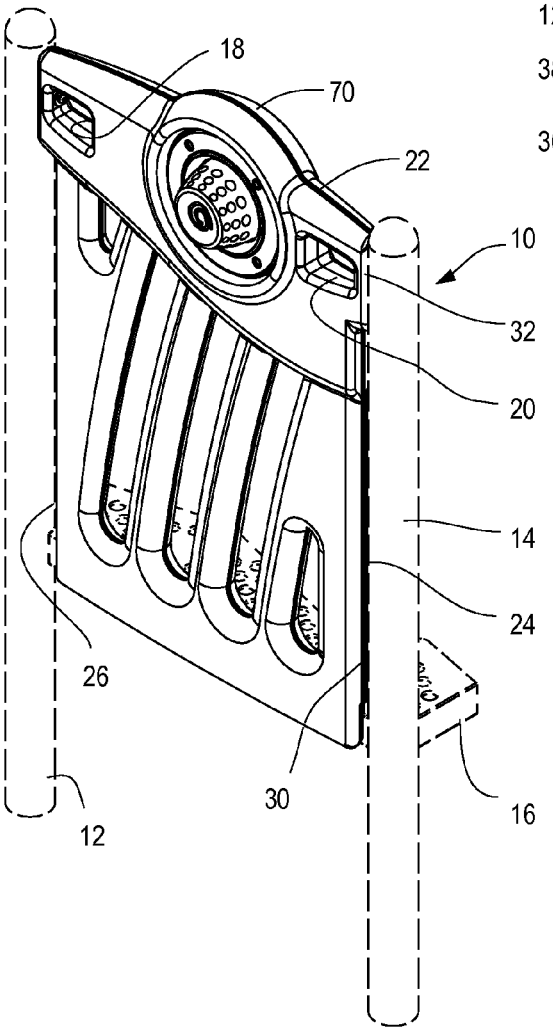
FIG. 1 is a top perspective view of a panel relative to two uprights and a deck as would be installed in accordance with a presently preferred embodiment of the present invention.

FIG. 1 shows a play panel 10 of a presently preferred embodiment of the present invention as connected to first and second posts 12,14, shown in phantom, as well as the deck 16, also shown in phantom. Details of the these connections will be shown in detail with reference to FIGS. 2 and 3.

FIG. 1 shows a panel 10 having first and second wings 18,20 in an upper portion of the panel 10 such as near the upper surface 22 of the panel 10 or at the upper surface 22 for some embodiments. Wings 18,20 preferably extend outwardly relative to side walls 24,26 such as spaced by a gap 30 which is a first distance. Gap preferably provides relatively uniform spacing between the uprights, or posts 12,14 and the panel 10 along the side walls 24,26 for many embodiments. In fact, side walls 24,26 may be parallel to the posts 12,14 for many embodiments. The wings 18,20 extend into this first distance of the gap 30 and, in many embodiments, contact an upright contact surface 32 of the wings 18,20 with the posts 12,14 illustrated. Posts 12,14 need not necessarily be cylindrically shaped, as illustrated, but could be square or other shape in various other embodiments.

The first and second posts 12,14 each have a threaded bore portion 36 along an exterior surface 38. Panel 10 has a side wall portion 26 which is spaced by the gap 30 from the exterior surface 38 of the first post 12. A cutout 40 is preferably provided in the wing 18 and is a part of the panel 10. The cutout 40 may be adjacent to the wing 18,20 if not in the wing 18,20 in other embodiments.

The cutout 40 preferably has an upper surface 42, lower surface 44, interior surface 46, and exterior surface 48 as illustrated in the presently preferred embodiment and also may have a well 50 as will be described in further detail below. The cutout 40 may extend from the front 52 to the rear 54 through the wing 18 of the panel 10 for the preferred embodiment. Other embodiments may have cutouts 40 that do not extend fully from the front 52 to the rear 54 of the panel 10.

A first connector 56 is illustrated passing through a lock washer 58, a spacing or flat washer 60 through the exterior wall 48 of the cutout 18 and possibly through the well 50, if provided, through the wing wall 62, and then through the exterior surface 38 and into the threaded bore 36 of the first pole 12. The threaded bore 36 preferably provides threaded engagement with the threads 55 of the first connector 56 in the preferred embodiment.

Figure 2:
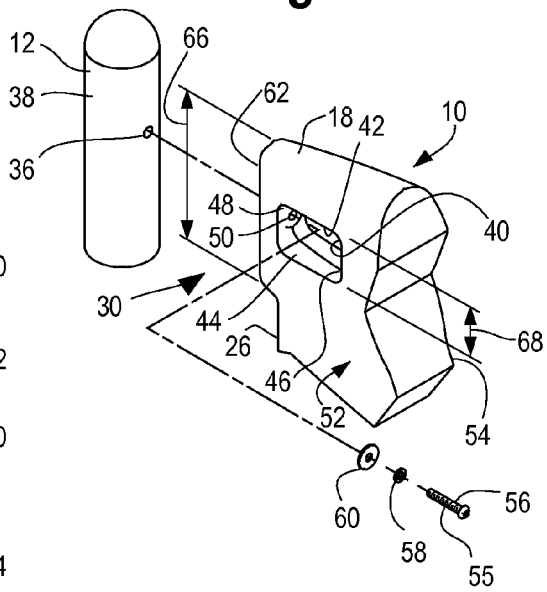
FIG. 2 is a detailed view of the connection at an upper portion of the panel shown in FIG. 1 to an upright.

Wing wall 62 also has an upright contact surface 32 shown in FIG. 2 would be understood from FIG. 1 is placed into adjacent contact with the first post 12 when installed.

Furthermore, as can be seen with reference to FIGS. 1 and 2, the upright contacts surface 32 surrounds the first connector 56. Furthermore, the upright contact surface 32 may be curved to cooperate with the exterior surface 38 of the first post which is curved in this embodiment. Other embodiments can be constructed differently.

The first contact surface 32 also extends a height 66 which is higher than a maximum height 68 of the cutout 40 with the maximum height 68 of the cutout 40 equating to a maximum height between the upper and lower surfaces 42,44 shown in FIG. 2. In fact, in the preferred embodiment, the upright contact surface 32 extends a height of the wing 18 where it contacts the first post 12.

Additionally, the exterior wall 48 of the cutout 40 is preferably closer to the first post 12 than the side wall 26 of the panel 10. Furthermore, the interior wall 46 of the cutout 40 is a further distance away from the first post 12 than the side wall 26 of the panel 10. The exterior wall 40 of the cutout 40 as well as the interior wall 46 of the cutout 40 are preferably parallel to the side wall 26.

When constructing the wing 18, it may be preferable to provide a well 50 which is closer to the first post 12 when installed than any other portion of the exterior wall 48 of the cutout 40.

Furthermore, the well 50 may have preferably received at least a first washer such as one selected from the flat or spacing washer 60 and the lock washer 58 shown with the first connector 56 proceeds through the wing wall 62 towards the first post 12.

In addition to the connection to the first post 12, it is anticipated that a virtually identical construction can be had symmetrically as it relates to construction and/or connection of the second wing 20 to the second post 14. It is noted that the panel 10 does not need to be entirely symmetrical or even symmetrical for other embodiments. In fact, as it relates to symmetry, it may be possible for at least some of the "T" or "+" configurations to be depending on how one views the panel 10. The panel 10 illustrated could meet either of these configurations as there is a higher elevation than the wings 18,20 (upper elevation 70) in the illustrated embodiment which could be viewed to provide a "+" configuration or could be viewed as giving rise to a "T" configuration.

The upper surface 22 of the panel 10, including the wings 18,20, often slope downward from towards the middle 70 towards the contact points with the first and second posts 12,14. The downward slope above the cutouts 40 may provide for a hand hold for at least some embodiments. Furthermore, as shown in FIG. 1, at least a portion of the panel 10 may extend the elevation up above any portion of the first and second posts 12,14.

Figure 3:
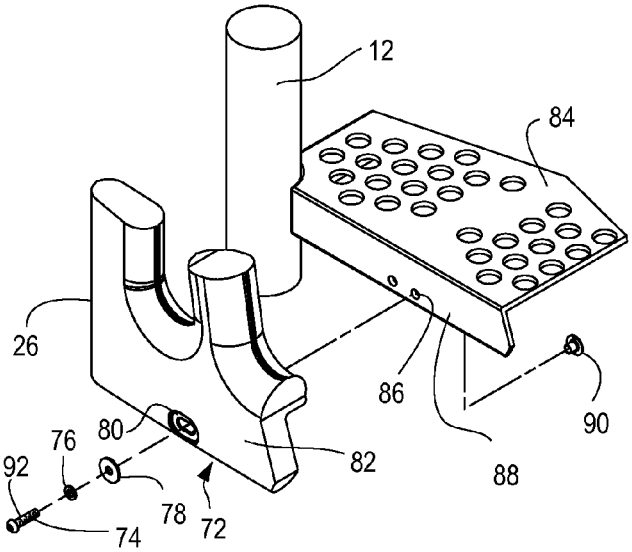
FIG. 3 is a detailed view of the connector at a lower portion of the panel shown in FIG. 1 to a deck.

FIG. 3 shows connection of the panel 10 which is at a lower portion, proximate to the bottom 72. A second connector 74 is shown extending through a lock washer 76 and a spacer or flat washer 78 through a well 80 in the lower portion 82 of the panel 10. It then proceeds on through the panel 10 into the deck 84 which can be connected to the first and second uprights or posts 12,14. Although post 12 is illustrated, connection at post 14 could be similarly provided as would be understood by those of ordinary skill in the art. The second connector 74 then proceeds through at least one bore 86 in the deck 84 which may provide a downwardly extending shoulder 88 with the bore 86. The second connector also preferably enters into engagement with a nut such as T-nut 90 (illustrated), which can capture threads 92 of second connector 74 to prevent sharp or harmful edges from contacting children. With a connected panel 10 with connections at wings 18,20 and deck connection(s), one may securely connect panel 10 for secure engagement.

With reference to FIG. 1, wings 18,20 may be thicker or wider than a width of a lower portion of panel 10 such as where a second connector 74 proceeds through to the panel 10. this may provide increased stability for at least some embodiments.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A play panel installation comprising:

a first post having a threaded bore portion along an exterior surface;

a panel having a first side wall spaced a first distance from the first post and a first wing integrally formed with and part of the panel extending into the first distance, said first wing having a cutout with an upper surface, lower surface, interior surface and exterior surface;

a first connector having a threaded exterior surface, the first connector extending from the cutout into the exterior surface of the wing, through the wing wall, and into the first post with threaded engagement of the threaded bore portion of the first post and the threaded exterior surface of the first connector.

2. The play panel installation of claim 1 further comprising the wing wall having an upright contact surface, wherein the upright contact surface is in contact with the first post.

3. The play panel installation of claim 2 wherein the upright contact surface surrounds the first connector and the upright contact surface is curved to coincide with a curved exterior surface of the first post.

4. The play panel installation of claim 3 wherein the upright contact surface extends a height longer than a maximum height extending between the upper and lower surfaces of the cutout.

5. The play panel installation of claim 3 wherein the upright contact surface extends a height of the wing where it contacts the first post.

6. The play panel installation of claim 1 wherein the exterior wall of the cutout is closer to the first post than the first side wall of the panel.

7. The play panel installation of claim 1 wherein the first side wall of the panel is closer to the first post than the interior wall of the cutout.

8. The play panel installation of claim 7 wherein the exterior wall of the cutout is parallel to the first side wall of the panel.

9. The play panel installation of claim 1 wherein the exterior wall of the cutout has a well, and the well receives the first connector, said well being closer to the first post than a closest portion of the exterior wall of the cutout.

10. The play panel installation of claim 9 wherein the well receives at least a first washer, with the first washer closer to the first post than the exterior surface of the cutout.

11. The play panel installation of claim 10 wherein the at least a first washer is at least one of a spacing washer and a lock washer.

12. The play panel installation of claim 9 wherein the panel has a front and a back and the cutout extends through the panel between the front and back.

13. The play panel installation of claim 1 further comprising a second wing wall symmetrically disposed relative to a second post to provide one of a T (tee) and a + (plus) configuration for the panel.

14. The play panel installation of claim 13 wherein the panel connects at a bottom portion of the panel to a deck.

15. The play panel installation of claim 14 wherein the panel comprises a planar outer surface having a well and a second connector extends through the well and the panel into the deck.

16. The play panel installation of claim 15 wherein the second connector extends through the deck and into engagement with a threaded nut retaining the panel to the deck.

17. The play panel installation of claim 16 wherein the deck contacts an inner surface of the panel.

18. The play panel installation of claim 15 wherein the panel is thicker at the wing than where the second connector proceeds into the deck at a bottom portion of the panel.

19. The play panel installation of claim 1 wherein the panel has an upper surface which is downwardly sloped above the upper surface of the cutout and assists in providing a hand hold.

20. The play panel installation of claim 19 wherein the panel has an upper elevation above the first post.

* * * * *